United States Patent [19]

Ishikawa et al.

[11] Patent Number: 4,876,174

[45] Date of Patent: Oct. 24, 1989

[54] METHOD OF PROCESSING SILVER HALIDE COLOR PHOTOSENSITIVE MATERIAL USING DEVELOPER COMPRISING DIALKYL HYDROXYLAMINE AND NO BENZYL ALCOHOL

[75] Inventors: Takatoshi Ishikawa; Morio Yagihara, both of Minami-Ashigara, Japan

[73] Assignee: Fuji Photo Film Co., Ltd., Minami-Ashigara, Japan

[21] Appl. No.: 63,469

[22] Filed: Jun. 18, 1987

[30] Foreign Application Priority Data

Jun. 24, 1986 [JP] Japan ..... 61-147822

[51] Int. Cl.[4] ..... G03C 7/30

[52] U.S. Cl. ..... 430/380; 430/434; 430/436; 430/464; 430/484; 430/485; 430/490

[58] Field of Search ..... 430/250, 372, 380, 432, 430/434, 435, 436, 464, 484, 485, 490

[56] References Cited

U.S. PATENT DOCUMENTS

| | | | |
|---|---|---|---|
| 3,287,124 | 11/1966 | Green et al. | 430/484 |
| 3,287,125 | 11/1966 | Green et al. | 430/484 |
| 3,293,034 | 12/1966 | Green et al. | 430/484 |
| 3,491,151 | 1/1970 | Bader | 430/484 |
| 3,996,054 | 12/1976 | Santemma et al. | 430/377 |
| 4,252,892 | 2/1981 | Case | 430/489 |
| 4,289,847 | 9/1981 | Ishikawa et al. | 430/389 |
| 4,482,626 | 11/1984 | Twist et al. | 430/490 |
| 4,542,091 | 9/1985 | Sasaki et al. | 430/380 |
| 4,543,322 | 9/1985 | Ishikawa et al. | 430/380 |
| 4,564,591 | 1/1986 | Tanaka et al. | 430/567 |
| 4,590,155 | 5/1986 | Klotzer | 430/567 |

FOREIGN PATENT DOCUMENTS

| | | |
|---|---|---|
| 59-160142 | 8/1981 | Japan . |
| 59-184341 | 3/1984 | Japan . |
| 158446 | 9/1985 | Japan . |
| 61-43742 | 7/1986 | Japan . |
| 59-160141 | 11/1987 | Japan . |

*Primary Examiner*—Paul R. Michl
*Assistant Examiner*—Patrick Doody
*Attorney, Agent, or Firm*—Burns, Doane, Swecker & Mathis

[57] ABSTRACT

The present invention relates to a method of processing a silver halide color photosensitive material. In particular, to a rapid processing method capable of reducing the development time. In the processing method, an exposed silver halide color photosensitive material having at least one emulsion layer containing a silver halide having a chlorine content of at least 80 molar % based on the total halogens is processed with a color developer containing an aromatic primary amine color developing agent and a dialkylhydroxylamine of the following general formula (I) but substantially free of benzyl alcohol:

(I)

wherein $R^1$ and $R^2$ each represent an unsubstituted or substituted alkyl group or an unsubstituted or substituted alkenyl group or $R^1$ and $R^2$ may form a hetero ring together with nitrogen atom.

15 Claims, No Drawings

METHOD OF PROCESSING SILVER HALIDE COLOR PHOTOSENSITIVE MATERIAL USING DEVELOPER COMPRISING DIALKYL HYDROXYLAMINE AND NO BENZYL ALCOHOL

BACKGROUND OF THE INVENTION (1) Field of the Invention

The present invention relates to a method of processing a silver halide color photosensitive material. In particular, the present invention relates to a rapid processing method which is capable of reducing the development time.

(2) Prior Art

Various methods have been proposed for reducing the processing time of color photosensitive materials. For example, methods wherein the color development time, bleach-fixing time, washing-with-water time or stabilization processing time is reduced have been proposed. In the method of reducing the color development time, a development accelerator is usually employed. However, it has been found to be difficult to greatly reduce the development time by this method.

Another method of reducing the development time comprises changing the type of the silver halide contained in the photosensitive material to be processed. Although the color development time can be reduced by using a silver halide having a high chlorine content as in the methods described in, for example, Japanese Patent Public Disclosure Nos. 58-95345, 59-23234 and 60-19140, these methods have a problem in that when the sensitive material is processed with a developer containing hydroxylamine used heretofore as a preservative, fog is caused during the development and the coloring of the color coupler is seriously inhibited. In particular, when the photosensitive material is processed with a developer free of benzyl alcohol which is contained in most developers, but which causes environmental pollution and which poses problems in the preparation of the developer, the inhibition of the coloring is further accelerated. On the other hand, when a hydroxylamine-free developer is used for the development, the stability of the developer is reduced and the photosensitive material cannot be processed continuously for a long period of time.

SUMMARY OF THE INVENTION

The present invention has been completed on the basis of a finding that the above-described problems can be effectively solved when a photosensitive material having a silver halide emulsion layer having a high chlorine content is processed with a developer containing an aromatic primary amine color developing agent and a special dialkylhydroxylamine.

It is therefore a primary object of the present invention to provide a method of processing a color photosensitive material capable of rapidly conducting the development without reducing the coloring power of the color coupler or stability of the developer.

This and other objects of the Invention will be clear from the following description.

In accordance with the present invention, there is provided a method of processing a silver halide color photosensitive material in which an exposed silver halide color photosensitive material having at least one emulsion layer containing a silver halide having a chlorine content of at least 80 molar % based on the total halogens is processed with a color developer containing an aromatic primary amine color developing agent and a dialkylhydroxylamine of the following general formula (I) but substantially free of benzyl alcohol:

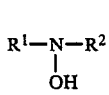

$$R^1-\underset{\underset{OH}{|}}{N}-R^2 \quad (I)$$

wherein $R^1$ and $R^2$ each represent an unsubstituted or substituted alkyl group or an unsubstituted or substituted alkenyl group or $R^1$ and $R^2$ may form a hetero ring together with nitrogen atom.

DESCRIPTION OF THE PREFERRED EMBODIMENTS

The aromatic primary amine color developing agents which are usable in the present invention include various known ones. Among them, p-phenylenediamine derivatives or mixtures of two or more of them are preferred. Examples of them include the following compounds:

D-1: N,N-diethyl-p-phenylenediamine

D-2: 2-amino-5-diethylaminotoluene

D-3: 2-amino-5-(N-ethyl-N-laurylamine)toluene,

D-4: 4-[N-ethyl-N-(β-hydroxyethyl)amino]aniline,

D-5: 2-methyl-4-[N-ethyl-N-(β-hydroxyethyl-)amino]aniline,

D-6: N-ethyl-N-(β-methanesulfonamidoethyl)-3-methyl-4-aminoaniline,

D-7: N-(2-amino-5-diethylaminophenylethyl)methanesulfonamide,

D-8: N,N-dimethyl-p-phenylenediamine,

D-9: 4-amino-3-methyl-N-ethyl-N-methoxyethylaniline,

D-10: 4-amino-3-methyl-N-ethyl-N-β-ethoxyethylaniline, and

D-11: 4-amino-3-methyl-N-ethyl-N-β-butoxyethylaniline.

These p-phenylenediamine derivatives may be in the form of their salts such as sulfates, hydrochlorides, sulfites and p-toluenesulfonates. The aromatic primary amine developing agent is used in an amount of about 0.1 to 20 g, preferably about 0.5 to 10 g, per liter of the developer.

The special dialkylhydroxyamine compounds to be used in combination with the developing agent are those of the above general formula (I). The alkyl and alkenyl groups in general formula (I) may be straight chain, branched or cyclic groups. Examples of their substituents include halogen atoms (such as F, Cl and Br), aryl groups (such as phenyl and p-chlorophenyl groups), alkoxy groups (such as methoxy, ethoxy and methoxyethoxy groups), aryloxy groups (such as phenoxy group), sulfonyl groups (such as methanesulfonyl and p-toluenesulfonyl groups), sulfonamido groups (such as methanesulfonamido and benzenesulfonamido groups), sulfamoyl groups (such as diethylsulfamoyl and unsubstituted sulfamoyl groups), carbamoyl groups (such as unsubstituted carbamoyl and diethylcarbamoyl groups), amido groups (such as acetamido and benzamido groups), ureido groups (such as methylureido and phenylureido groups), alkoxycarbonylamino groups (such as methoxycarbonylamino group), aryloxycarbonylamino groups (such as phenoxycarbonylamino group), alkoxycarbonyl groups (such as methoxycarbonyl group), aryloxycarbonyl groups (such as phenoxycarbonyl group), cyano group, hydroxy group, carboxy group, sulfo group, nitro group, amino groups (such as unsubstituted amino group and diethylamino group), alkylthio groups (such as methylthio group), arylthio groups (such as phenylthio group) and heterocyclic groups (such as morpholyl and pyridyl groups). $R^1$ and $R^2$ in the above formula may be the same or different and the substituents of them may be also the same or different.

In general formula (I) of the dialkylhydroxylamines usable in the present invention, $R^1$ and $R^2$ each have preferably 1 to 5 carbon atoms, particularly 1 to 'carbon atoms. The nitrogen-containing heterorings formed by bonding $R^1$ and $R^2$ together include, for example, piperidyl, pyrrolidilyl, N-alkylpiperazyl, morpholyl, indolinyl and benztriazolyl groups.

Examples of the compounds of general formula (I) which are usable in the present invention are as follows, which by no means limit the compounds of the present invention:

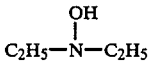
(1)

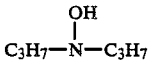
(2)

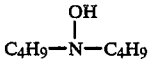
(3)

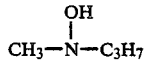
(4)

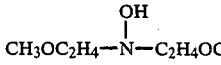
(5)

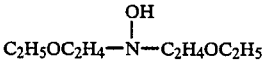
(6)

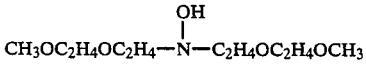
(7)

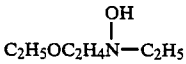
(8)

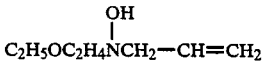
(9)

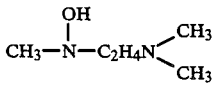
(10)

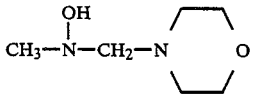
(11)

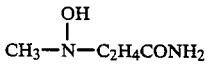
(12)

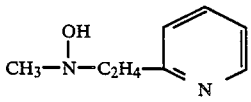
(13)

-continued

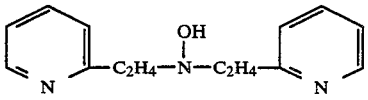
(14)

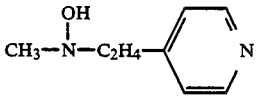
(15)

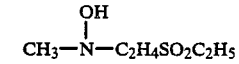
(16)

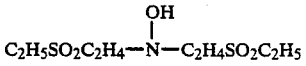
(17)

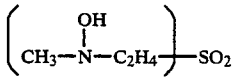
(18)

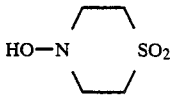
(19)

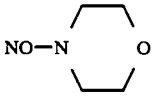
(20)

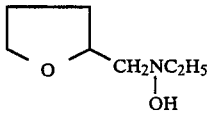
(21)

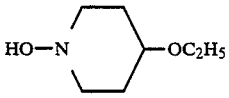
(22)

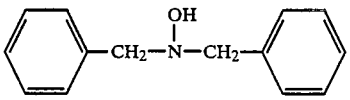
(23)

These compounds may be used either singly or as a combination of two or more of them. Among the above-mentioned compounds, compounds (1), (2), (5) and (6) are particularly preferred in the present invention. The compounds of general formula (I) can be produced by a known method described in, for example, U.S. Pat. Nos. 3,661,996, 3,362,961 and 3,293,034, Japanese Patent Publication No. 42-2,794, U.S. Pat. Nos. 3,491,151, 3,655,764, 3,467,711, 3,455,916, 3,287,125 and 3,287,124.

The dialkylhydroxyamine of above general formula (I) is contained in an amount of 0.05 to 20 g/l, preferably 0.5 to 10 g/l, in the developer in the present invention.

It is an important feature of the present invention to use the developer which is substantially free of benzyl alcohol. The term "substantially free of benzyl alcohol" means that benzyl alcohol content of the developer is less than 2 ml/l. Preferably that the developer is totally free of benzyl alcohol.

An indispensable condition of the color developer composition usable in the present invention is that it contains the above-described two components but is substantially free of benzyl alcohol. The balance of the composition comprises water or an organic solvent-containing water. The composition may further contain the following additives, if necessary:

Alkanolamines

One or a mixture of two or more of alkanolamines used heretofore can be used. Examples of the alkanolamines include those of general formula (II):

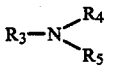

(II)

wherein $R_3$ represents a hydroxyalkyl group having 2 to 6 carbon atoms and $R_4$ and $R_5$ each represent a hydrogen atom, an alkyl group having 1 to 6 carbon atoms, hydroxyalkyl group having 2 to 6 carbon atoms, benzyl group or a group of the formula:

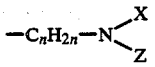

in which n is an integer of 1 to 6 and X and Z each represent a hydrogen atom, an alkyl group having 1 to 6 carbon atoms or a hydroxyalkyl group having 2 to 6 carbon atoms.

Examples of the alkanolamines include ethanolamine, diethanolamine, triethanolamine, diisopropanolamine, 2-methylaminoethaneol, 2-ethylaminoethanol, dimethylaminoethanol, 2-diethylaminoethanol, 1-diethylamino-2-propanol, benzylethanolamine and isopropylaminoethanol. The alkanolamines are not limited to these examples.

The alkanolamines may be in the form of salts with acids such as hydrochlorides, sulfates, nitrates, acetates and oxalates.

These alkanolamines are preferably used for improving the moisture retention in an amount of 0.01 to 20 g, preferably 0.1 to 10 g and particularly 1 to 8 g, per liter of the color developer.

Preservation

Preferably, the developer contains sulfites such as sodium sulfite, potassium sulfite, sodium bisulfite, potassium bisulfite, sodium metasulfite and potassium metasulfite; and carbonyl sulfuric acid additives. The amount of the preservative is 0 to 20 g/l, preferably 0 to 5 g/l. The smaller the amount of preservative, the better, so the color developer can be kept stable.

Among these preservatives, those releasing a sulfite ion and/or bisulfite ion are particularly preferred, since they are capable of improving the storability and effectively preventing the coloring of the color developer with time. The preservatives are used preferably in such an amount that $SO_3^{2-}$-concentration is in the range of $1\times10^{-4}$ to $5\times10^{-2}$ mol/l, preferably $2.5\times10^{-3}$ to $2.5\times10^{-2}$ mol/l.

Buffering agent

The pH of the color developer is kept in the range of 9 to 12, preferably 9 to 11.0. The pH is kept in this range preferably with a buffering agent.

The buffering agents include, for example, carbonates, phosphates, borates, tetraborates, hydroxybenzoates, glycine salts, N,N-dimethylglycine salts, leucine salts, norleucine salts, guanine salts, 3,4-dihydroxyphenylalanine salts, alanine salts, aminobutyrates, 2-amino-2-methyl-1,3-propanediol salts, valine salts, proline salts, trishydrodiaminomethane salts and lysine salts. Among them, the carbonates, phosphates, tetraborates and hydroxybenzoates are particularly preferred, since they have a high solubility and excellent buffering capacity in a high pH region of higher than 9.0, they exert no bad influence (such as fog) on the photographic properties and they are inexpensive.

Examples of buffering agents include sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate) and potassium 5-sulfo-2-hydroxybenzoate (potassium 5-sulfosalicylate). However, the buffering agents are not limited to these.

The amount of the buffering agent to be added to the color developer is preferably at least 0.1 mol/l, particularly 0.1 to 0.4 mol/l.

Chelating agent

Chelating agents can be added to the color developer in order to prevent the precipitation of calcium and magnesium or to improve the stability of the color developer.

The chelating agents are preferably organic acids such as the aminopolycarboxylic acids described in Japanese Patent Publication Nos. 48-30496 and 44-30232, organophosphonic acids described in Japanese Patent Public Disclosure No. 56-97347, Japanese Patent Publication No. 56-39359 and West German Patent No. 2227639, phosphonocarboxylic acids described in Japanese Patent Public Disclosure Nos. 52-102726, 53-42730, 54-121127, 55-126241 and 55-65956 and compounds described in Japanese Patent Public Disclosure Nos. 58-195845 and 58-203440 and Japanese Patent Publication No. 53-40900. Examples of the chelating agents include the following compounds, which by no means limit them:

nitrilotriacetic acid,
diethylenetriaminepentaacetic acid,
triethylenetetraminehexaacetic acid,
N,N,N-trimethylenephosphonic acid,
ethylenediamine-N,N,N',N'-tetramethylenephosphonic acid,
1,3-diamino-2-propanol-tetraacetic acid,
trans-cyclohexanediaminetetraacetic acid,
nitrilotripropionic acid,
1,2-diaminopropanetetraacetic acid,
hydroxyethyliminodiacetic acid,
glycol etherdiaminetetraacetic acid,
hydroxyethylenediaminetriacetic acid,
ethylenediamine-o-hydroxyphenylcetic acid,
2-phosphonobutane-1,2,4-tricarboxylic acid,
1-hydroxyethylidene-1,1-diphosphonic acid,
ethylenediaminetetraacetic acid, and
N,N'-bis(2-hydroxybenzyl)ethylenediamine-N,N'-diacetic acid.

If necessary, these chelating agents may be used in the form of a combination of two or more of them.

The chelating agent is used in an amont sufficient for the sequestering such as about 0.1 to 10 g per liter of the color developer.

Development accelerator

A development accelerator can be added to the color developer, if necessary. Examples of the development accelerators include the thioether compounds described in Japanese Patent Publication Nos. 37-16088, 37-5987, 38-7826, 44-12380 and 45-9019 and U.S. Pat. No. 3813247, the p-phenylenediamine compounds described in Japanese Patent Public Disclosure Nos. 52-49829 and 50-15554, the quaternary ammonium salts described in Japanese Patent Public Disclosure No. 50-137726, Japanese Patent Publication No. 44-30074 and Japanese Patent Public Disclosure Nos. 56-156826 and 52-43429, the p-aminophenols described in U.S. Pat. Nos. 2610122 and 4119462, the amine compounds described in U.S. Pat. Nos. 2494903, 3128182, 4230796 and 3253919, Japanese Patent Publication No. 41-11431 and U.S. Pat. Nos. 2482546, 2596926 and 3582346, the polyalkylene oxides described in Japanese Patent Publication Nos. 37-16088 and 42-25201, U.S. Pat. No. 3128183, Japanese Patent Publication Nos. 41-11431 and 42-23883 and U.S. Pat. No. 3532501, and 1-phenyl-3-pyrazolidones, hydrazines, mesoionic compounds, ionic compounds and imidazoles.

Antifoggants

An antifoggant can also be added to the color developer, if necessary, in the present invention. The antifoggants include alkali metal halides such as potassium bromide, sodium chloride and potassium iodide and organic antifoggants. Examples of the organic antifoggants include nitrogen-containing heterocyclic compounds such as benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethylbenzimidazole and hydroxyazaindolidine; mercapto-substituted heterocyclic compounds such as 1-phenyl-5-mercaptotetrazole, 2-mercaptobenzimidazole and 2-mercaptobenzothiazole; and mercapto-substituted aromatic compounds such as thiosalicylic acid. Among them, the nitrogen-containing heterocyclic compounds are particularly preferred. These antifoggants may be eluted out of the color photosensitive material and accumulated in the color developer.

Fluorescent brightening agent

The color developer of the present invention preferably contains a fluorescent brightening agent. Preferred fluorescent brightening agents are 4,4'-diamino-2,2'-disulfostilbene compounds. They are used in an amount of 0 to 5 g/l, preferably 0.1 to 2 g/l.

Surfactants

A surfactant such as an alkylsulfonic acid, arylphosphonic acid, aliphatic carboxylic acid or aromatic carboxylic acid may be added to the color developer.

The color developer of the present invention is used at a processing temperature of 20° to 50° C., preferably 30° to 40° C. for 20 sec. to 5 min., preferably 30 sec. to 2 min. The quantity of the replenisher is desirably as small as possible. In fact, the quantity is 20 to 600 ml, preferably 50 to 300 ml, and particularly 100 to 200 ml, per square meter of the photosensitive material.

The present invention is characterized in that a silver halide color photosensitive material having at least one emulsion layer containing a silver halide having a chlorine content of at lest 80 molar %, based on the total halogens, is exposed and then processed.

The silver halides include silver chlorobromide and silver chlorobromoiodide having a chlorine content of at least 80%, preferably at least 90%. Silver chloride is also preferred. The silver halide in the form of grains of various shapes is contained in the emulsion layer. In particular, when a silver halide in the form of tabular grains is used, the sensitivity including the color sensitization efficiency of the sensitizing dye can be improved, the relationship between the sensitivity and the graininess is improved, the sharpness is improved, the rate of the development is improved, the covering power is improved and the cross over is improved.

The term "tabular silver halide grains" means that the grains have a rate of the diameter ot the thickness thereof of at least 5. For example, the grains have a diameter/thickness ratio of higher than 8 or in the range of 5 to 8.

The photosensitive material to be processed by the present invention may contain various color couplers. The term "color couplers" herein means compounds capable of participating in the coupling-reaction with an oxidation product of the aromatic primary amine developing agent to produce a dye. Typical examples of the useful color couplers include naphthol or phenol compounds, pyrazolone or pyrazoloazole compounds and closed chain or heterocyclic ketomethylene compounds. Examples of these cyan, Magenta and yellow couplers usable in the present invention are described in patents described in Research Disclosure (RD) No. 17643 (December, 1978) VII-D and No. 18717 (November, 1979).

The color couplers to be contained in the photosensitive material are made nondiffusible by introducing a ballast group therein or by polymerizing the same. A 2-equivalent coupler substituted with a coupling split-off group is preferable to a 4-equivalent coupler in which the coupling active position is hydrogen with regard to the reduction of the amount of the coating silver. Further, a coupler in which a coloring dye has a suitable diffusivity, a non-coloring coupler, DIR coupler which releases a development inhibitor in the coupling reaction or a coupler which releases a development accelerator can also be used.

Typical examples of the yellow couplers include oil-protecting type-acylacetamide couplers such as those described in U.S. Pat. Nos. 2,407,210, 2,875,057 and 3,265,506. 2-Equivalent yellow couplers are preferably used in the present invention. Typical examples include the oxygen atom-split-off type-yellow couplers described in U.S. Pat. Nos. 3,408,194, 3,447,928, 3,933,501 and 4,022,620 and the nitrogen atom-split-off type yellow couplers described in Japanese Patent Publication No. 58-10739, U.S. Pat. Nos. 4,401,752 and 4,326,024, RD No. 18053 (April, 1979), British Pat. No. 1,425,020, West German Patent Public Disclosure Nos. 2,219,917, 2,261,361, 2,329,587 and 2,433,812, α-Pivaloylacetanilide couplers provide an excellent fastness, particularly light fastness, of the dye and α-benzoylacetanilide couplers provide a high color density.

Magenta couplers include oil-protecting type-indazolone and cyanoacetyl couplers, preferably 5-pyrazolone couplers and pyrazoloazole couplers such as pyrazolotriazole couplers. Among the 5-pyrazolone couplers, those having an arylamino group or acylamino group in position 3 are preferred from the viewpoint of the hue of the coloring dye or color density. Typical examples of them are described in U.S. Pat. Nos. 2,311,082, 2,343,703, 2,600,788, 2,908,573, 3,062,653, 3,152,896 and 3,936,015. The split-off groups of the 2-equivalent 5-pyrazolone couplers are particularly preferably nitrogen atom-split-off groups described in U.S. Pat. No. 4,310,619 and arylthio groups described in U.S. Pat. No. 4,351,897. 5-Pyrazolone couplers having ballast groups as described in European Pat. No. 73,636 provide a high color density.

Examples of the pyrazoloazole couplers include pyrazolobenzimidazoles described in U.S. Pat. No. 3,061,432, preferably pyrazolo[5,1-c][1,2,4]triazoles described in U.S. Pat. No. 3,725,067, pyrazolotetrazoles described in Research Disclosure, No. 24220 (June, 1984) and Japanese Patent Public Disclosure No. 60-33552, and pyrazolopyrazoles described in Research Disclosure, No. 24230 (June, 1984) and Japanese Patent Public disclosure No. 60-43659. Imidazo 1,2-b pyrazoles described in U.S. Pat. No. 4,500,630 are preferred because of smallness of the yellow and highness of the light fastness and particularly pyrazolo 1,5-b 1,2,4 triazole described in U.S. Pat. No. 4,540,654 is preferred.

The cyan couplers include oil-protecting type-naththol and phenol couplers. Typical examples include naphthol coupler described in U.S. Pat. No. 2,474,293, preferably oxygen atom split-off type-2-equivalent naphthol couplers described in U.S. Pat. Nos. 4,052,212, 4,146,396, 4,228,233 and 4,296,200. Typical examples of the phenol couplers are described in U.S. Pat. Nos. 2,369,929, 2,801,171, 2,772,162 and 2,895,826. Cyan couplers stable to moisture and temperature are preferably used in the present invention. Typical examples include phenolic cyan couplers having an ethyl or higher alkyl group in m-position of the phenol nucleus as described in U.S. Pat. No. 3,772,002, 2,5-diacylamino-substituted phenol couplers described in U.S. Pat. Nos. 2,772,162, 3,758,308, 4,126,396, 4,334,011 and 4,327,173, West German Patent Public Disclosure No. 3,329,729 and European Patent No. 121,365, and phenol couplers having a phenylureido group in position 2 and an acylamino group in position 5 as described in U.S. Pat. Nos. 3,446,622, 4,333,999, 4,451,559 and 4,427,767. Cyan couplers having a sulfonamido group or amido group in position 5 of the naphthol as described in Japanese Patent Application Nos. 59-93605, 59-264277 and 59-268135 provide a colored image having an excellent fastness and they can be preferably used in the present invention.

It is preferable to use a photographic color negative light-sensitive material in combination with a color coupler so as to correct for unnecessary absorption in a short wave length region of a dye formed from the Magenta or cyan coupler. Typical examples of them include yellow-coloring Magenta couplers described in U.S. Pat. No. 4,163,670 and Magenta-coloring cyan couplers described in U.S. Pat. Nos. 4,004,929 and 4,138,258 and British Pat. No. 1,146,368.

Further, the developer can contain an antioxidant, coloring accelerator, U.V. absorber, fading inhibitor for cyan, magenta and/or yellow dye images, color-mixing inhibitor, antistaining agent, antifoggant, spectral sensitizer, dye, hardener, surfactant, antistatic agent, development accelerator and desilverization accelerator.

Photosensitive materials having various known layer structures can be processed with the developer of the present invention. Among them, examples of the preferred layer structures are shown below. Examples of the supports include flexible ones usually used for the photosensitive materials such as plastic films, papers and cloths, and glass, porcelain and metal supports. In particular, baryta paper and a paper laminated with polyethylene containing a white pigment (such as titanium oxide) and preferred. Examples of them are described particularly in Research Disclosure, No. 17643, pages 23 to 27 and No. 18716, pages 648 to 650:

(i) Support-BL-MC-GL-MC-RL-PC(2)-PC(1), (ii) Support-BL-MC-RL-MC-GL-PC(2)-PC(1), (iii) Support-RL-MC-GL-MC-BL-PC(2)-PC(1), (iv) Support-RL-MC-BL-MC-GL-PC(2)-PC(1), and (v) Support-BL(2)-BL(1)-MC-GL(2)-GL(1)-MC-RL(2)-RL(1)-PC(2)-PC(1), wherein PC(1) and PC(2) each represent a non-photosensitive layer, MC represents an intermediate layer, BL represents a blue-sensitive emulsion layer, GL represents a green-sensitive emulsion layer and RL represents a red-sensitive emulsion layer.

Examples of the silver halide color photosensitive materials having the above-mentioned structure include color negative films, color papers, color positive films and color reversal films.

Processing method

According to the present invention, the photosensitive material is developed with the developer and then processed by an ordinary method. The typical processing steps, including the development step, will be shown below, which by no means limit the steps:

A. Color development-bleach-fix-washing with water-drying,

B. Color development-bleach-fix-washing with water-stabilization-drying,

C. Color development-washing with water-bleach-fix-washing with water-drying,

D. Color development-bleaching-fixing-washing with water-stabilization-drying,

E. Color development-bleaching-fixing-washing with water-drying,

F. Color development-washing with water-bleaching-fixing-washing with water-drying, G. Color development-bleaching-bleach-fix-washing with water-stabilization-drying, H. Color development-bleaching-bleach-fix-washing with water-drying, I. Color development-bleaching-bleach-fix-fixing-washing with water-stabilization-drying, and J. Color development-bleaching-bleach-fixing-fixing-washing with water-drying.

When the step of washing with water is conducted previously to the stabilization step in the above methods, the former step can be omitted to conduct the stabilization step directly.

Bleaching solution, bleach-fixing solution and fixing solution

The bleaching agents contained in the bleaching solutions and bleach-fixing solutions are ferric ion complexes comprising ferric ion and a chelating agent such as an aminopolycarboxylic acid, an aminopolyphosphonic acid or a salt thereof. The salts of the aminopolycarboxylic acids or aminopolyphosphonic acids are such salts with alkali metals, ammonium or water-soluble amines. The alkali metals include sodium, potassium and lithium, and the water-soluble amines include alkylamines such as methylamine, diethylamine, triethylamine and butylamine, alicyclic amines such as cyclohexylamine, arylamines such as aniline and m-toluidine and heterocyclic amines such as pyridine, morpholine and piperidine.

Typical examples of the chelating agents such as the aminopolycarboxylic acids, aminopolyphosphonic acids and salts thereof include:

ethylenediaminetetraacetic acid,
disodium ethylenediaminetetraacetate,
diammonium ethylenediaminetetraacetate,
1,2-diaminopropanetetraacetic acid,
disodium 1,2-diaminopropanetetraacetate,
1,3-diaminopropanetetraacetic acid, diammonium 1,3-diaminopropanetetraacetate,
nitrilotriacetic acid,
trisodium nitrilotriacetate,
1,3-diaminopropanol-N,N,N',N'-tetramethylenephosphonic acid,
ethylenediamine N,N,N',N'-tetramethylenephosphonic acid, and
1,3-propylenediamine-N,N,N',N'-tetramethylenephosphonic acid As a matter of course, the chelating agents are not limited to those listed above.

The ferric ion complex salts can be used as they are or they can be formed in situ by reacting a ferric salt such as ferric sulfate, ferric chloride, ferric nitrate, ammonium ferric sulfate or ferric phosphate with a chelating agent such as an aminopolycarboxylic acid, an aminopolyphosphonic acid or a phosphonocarboxylic acid. The complex salts may be used either singly or as a combination of two or more of them. If the complex salt is to be formed from the ferric salt and the chelating agent in situ in the solution, the ferric salts may be used either singly or as a combination of them and the chelating agents may be used also either singly or as a combination of them. In both cases, the chelating agent(s) can be used in an amount more than that necessitated for forming the ferric ion complex salt. Among the iron complexes, an aminopolycarboxylic acid/iron complex is preferred and it is used in an amount of 0.1 to 1 mol, preferably 0.2 to 0.4 mol per liter of the bleaching solution for the photographic color photosensitive material such as a negative color film and 0.05 to 0.5 mol, preferably 0.1 to 0.3 mol per liter of the bleach-fixing solution. This complex is used in an amount of 0.03 to 0.3 mol, preferably 0.05 to 0.2 mol, per liter of the bleaching solution or bleach-fixing solution for the printing color photosensitive material such as a color paper.

A bleaching accelerator can be incorporated in the bleaching solution or bleach-fixing solution, if necessary. Examples of usable bleaching accelerators include compounds having a mercapto group or disulfido group as described in U.S. Pat. No. 3,893,858, West German Pat. No. 1,290,812 and 2,059,988, Japanese Patent Public Disclosure Nos. 53-32736, 53-57831, 53-37418, 53-65732, 53-72623, 53-95630, 53-95631, 53-104232, 53-124424, 53-141623 and 53-28426 and Research Disclosure, No. 17129 (July, 1978); thiazolidine derivatives described in Japanese Patent Public Disclosure No. 50-140129; thiourea derivatives described in Japanese Patent Publication No. 45-8506, Japanese Patent Public Disclosure Nos. 52-20832 and 53-32735 and U.S. Pat. No. 3,706,561; iodides described in West German Pat. No. 1,127,715 and Japanese Patent Public Disclosure No. 58-16235; polyethylene oxides described in West German Pat. Nos. 966,410 and 2,748,430; polyamine compounds described in Japanese Patent Publication No. 45-8836; compounds described in Japanese Patent Public Disclosure Nos. 49-42434, 49-59644, 53-94927, 54-35727, 55-26506 and 58-163940; and iodine and bromine ions. Among them, the compounds having a mercapto group or disulfido group are preferred because they have remarkable accelerating effects. Compounds described in U.S. Pat. No. 3,893,858, West German Pat. No. 1,290,812 and Japanese Patent Public Disclosure No. 53-95630 are particularly preferred.

The bleaching solution or bleach-fixing solution of the present invention can contain a rehalogenating agent such as a bromide (e.g. potassium bromide, sodium bromide or ammonium bromide), a chloride (e.g. potassium choride, sodium chloride or ammonium chloride) or an iodide (e.g. ammonium iodide). If necessary, the bleaching solution or bleach-fixing solution can contain one or more inorganic acids, organic acids and alkali metal salts are ammonium salts of them having a pH-buffering effect such as boric acid, borax, sodium metaborate, acetic acid, sodium acetate, sodium carbonate, potassium carbonate, phosphorous acid, phosphoric acid, sodium phosphate, citric acid, sodium citrate and tartaric acid or anticorrosive agents such as ammonium nitrate and guanidine.

The fixing agents to be contained in the bleach-fixing solution or fixing solution according to the present invention are known water-soluble solubilizers for silver halides, for example, thiosulfates such as sodium thiosulfate and ammonium thiosulfate; thiocyanates such as sodium thiocyanate and ammonium thiocyanate; thioether compounds such as ethylenebisthioglycolic acid and 3,6-dithia-1,8-octanediol and thioureas. They may be used either singly or as a mixture. Further, a special bleach-fixing solution comprising a combination of a fixing agent and a large amount of a halide such as potassium iodide as described in Japanese Patent Public Disclosure No. 51-155354 can be used. Thiosulfates, particularly ammonium thiosulfate, are used preferably in the present invention.

The amount of the fixing agent is preferably 0.3 to 2 mol per liter of the fixing agent. Particularly, the amount is 0.8 to 1.5 mol in the processing of a photographic color photosensitive material and the amount is 0.5 to 1 mol in the processing of a printing color photosensitive material.

The pH of the bleach-fixing solution or the fixing solution is preferably in the range of 3 to 10 and particularly 5 to 9. When the pH is lower than this range, the deterioration of the solution and the conversion of the cyan dye into leuco-dye are accelerated, while the desilverization is also accelerated. On the contrary, when the pH is higher than this range, the desilverization is delayed and stains are formed.

The pH can be adjusted by suitably adding hydrochloric acid, sulfuric acid, nitric acid, acetic acid, a bicarbonate, ammonia, potassium hydroxide, sodium hydroxide, sodium carbonate or potassium carbonate.

The bleach-fixing solution can contain further a fluorescent brightening agent, a defoaming agent, a surfactant or an organic solvent such as polyvinylpyrrolidone or methanol.

The bleach-fixing solution and the fixing solution contain as the preservative a sulfite ion-releasing compound, for example, a sulfite (such as sodium sulfite, potassium sulfite or ammonium sulfite), bisulfite (such as ammonium bisulfite, sodium bisulfite or potassium bisulfite) or metabisulfite (such as potassium metabisulfite, sodium metabisulfite or ammonium metabisulfite).

Washing with water and stabilization

The desilverization step (bleach-fixing step or fixing step) is followed by the step of washing with water and/or stabilization. In the washing-with-water step and the stabilization step, various compounds can be used for various purposes. For example, it has been known to use germicides and antifungal agents for keeping the material from bacteria, fungi and algae. The compounds usable for this purpose include, for example, compounds described in J. Antibact. Antifung. Agents, Vol. 11, No. 5, pages 207 to 223 (1983), compounds described in Hiroshi Horiguchi's "Bokin Bobai no Kagaku", and compounds described in Japanese Patent Public Disclosure Nos. 57-8543, 57-58143, 57-97530, 58-105145, 58-134636, 59-91440, 59-126533, 59-184344, 59-185336, 60-239750, 60-239751, 60-247241, 60-260952, 61-2149, 61-28947 and 61-28945 and Japanese Patent Application Nos. 59-158475 and 60-105487. The processing methods described therein can also be employed.

Particularly useful compounds include, for example, isothiazolone derivatives (such as 2-octyl-4-isothiazolin-3-one and 5-chloro-2-methyl-4-isothiazolin-3-one), sulfanylamide derivatives (such as sulfanylamide) and benzotriazole derivatives (such as benzotriazole, 5-methylbenzotriazole and 5-chlorobenzotriazole).

It has been known to use a chelating agent in order to improve the image stability after the processing. The chelating agents usable for this purpose include, for example, inorganic phosphoric acids, organic carboxylic acids, aminopolycarboxylic acids and organic phosphonic acids. Compounds and processing methods described in Japanese Patent Public Disclosure Nos. 57-8543, 57-197540, 58-14834, 58-134636, 59-126533, 59-184343, 59-184344, 59-184345, 59-1855336, 60-135942, 60-238832, 60-239748, 60-239749, 60-239750, 60-239751, 60-242458, 60-262161, 61-4047, 61-4050, 61-4051, 61-4052, 61-4053, 61-4054, 61-28942 and 61-28945 can be employed.

Particularly, ethylenediaminetetraacetic acid, diethylenetriaminepentaacetic acid, nitrilotriacetic acid, 1-hydroxyethylidene-1,1'-diphosphonic acid and ethylenediaminetetramethylphosphonic acid are useful.

These chelating agents can be used in combination with a metal compound. The metal compounds include, for example, bismuth compounds described in Japanese Patent Public Disclosure No. 58-134636, Ba, Ca, Ce, Co, In, La, Mn, Ni, Pb, Ti, Sn, Zn and Zr compounds described in Japanese Patent Public Disclosure No. 59-184344 and Mg, Al and Sr compounds described in Japanese Patent Public Disclosure No. 59-185336. Among them, Bi, Ca, Mg and Al compounds are especially effective.

For conducting the step of washing with water effectively, various methods can be employed such as a method wherein a surfactant is used as described in Japanese Patent Public Disclosure No. 57-197540, a method wherein the material is contacted with an ion exchange resin in order to remove components which exert a bad influence (Japanese Patent Public Disclosure No. 66-220345), a reverse osmosis method (Japanese Patent Public Disclosure No. 60-241053) and a method wherein the material is contacted with an active carbon, clayey substance, polyamide, polyurethane, phenolic resin, epoxy resin, high molecular compound having a hydrazido group, high molecular compound containing polytetrafluoroethylene, or a monohydric or polyhydric alcohol methacrylate monoester/polyhydric alcohol methacrylate polyester copolymer (Japanese Patent Public Disclosure No. 60-263151) and electrodialysis method (Japanese Patent Public Disclosure No. 61-28949).

Other methods for protecting the material from bacterial or fungi include a method of irradiation with U.V. rays and a method wherein the material is passed through a magnetic field. When the processing is to be conducted continuously, methods described in Japanese Patent Public Disclosure Nos. 60-233651, 60-235133, 60-263941, 61-4048, 61-4049, 61-4055, 61-4056, 61-4057, 61-4058 and 61-4060 can be employed.

A fluorescent brightening agent, hardener, etc. can be added, in addition to the above-mentioned additives, to water used for the washing and the stabilization bath.

It is preferred for improving the image stability to add an ammonium salt such as ammonium chloride, ammonium nitrate, ammonium sulfate, ammonium phosphate, ammonium sulfite or ammonium thiosulfate as a pH adjustor for the film after the processing.

The additives may be used either singly or as a combination of two or more having the same or different effects depending to the purpose of the use. The amount of the additives is preferably as small as possible so far as the purpose can be attained, from the viewpoint of the physical properties (such as stickiness) of the emulsion film of the processed photosensitive material.

It is preferred to use two or more vessels to provide a multistage counter current for reducing the quantity of the replenisher. The quantity of the replenisher is preferably 0.1 to 50 parts, particularly 3 to 30 parts, per part of that brought from the preceding bath per a unit area of the photosensitive material.

The time required for the washing with water or stabilization according to the present invention is 20 sec. to 2 min., preferably 20 sec. to 1 min. 30 sec., though it varies depending on the variety of the photosensitive material and processing conditions.

The washing with water or stabilization is conducted at a temperature of 20° to 45° C., preferably 25° to 40° C. and particularly 30° to 35° C.

For improving the effect of removing the components from the film by washing in the step of washing with water or the stabilization step, it is preferred to circulate or to stir the solution particularly in such a manner that the current of the solution impinges against the surface of the emulsion film of the photosensitive material (such as stirring by means of a gas or spray of the solution).

If necessary, a heater, temperature sensor, liquid level sensor, circulating pump, filter, floating lid, squeegee, stirring means with nitrogen and stirring means with air can be provided in the respective processing baths.

According to the present invention, excellent development processing can be conducted in a short period of time with a developer substantially free of benzyl alcohol.

The following examples will further illustrate the present invention, which by no means limit the invention.

EXAMPLE 1

A multilayered color photographic printing paper was prepared by forming emulsion layers on a paper support both surfaces of which were laminated with polyethylene. The emulsions used herein were prepared as follows:

27.2 ml of ethyl acetate and 7.9 ml of solvent (c) were added to 19.1 g of yellow coupler (a) and 4.4 g of color image stabilizer (b) to obtain a solution, which was dispersed in 185 ml of 10% aqueous gelatin solution containing 8 ml of 10% sodium dodecylbenzenesulfonate to prepare an emulsified dispersion. On the other hand, $5.0\times10^{-4}$ mol, per mol of silver chlorobromide, of the following blue-sensitive sensitizing dye was added to a silver chlorobromide emulsion (containing 1.0 molar % of silver bromide and 70 g/kg of Ag) to produce 90 g of a blue-sensitive emulsion. The emulsified dispersion and the emulsion were mixed together to produce a solution. The gelatin concentration of the solution was adjusted so as to obtain the composition shown in Table B to produce the first layer-forming coating solution.

The coating solutions for forming the second layer through the seventh layer were prepared in the same manner as described above. Sodium 1-hydroxy-3,5-dichloro-S-triazine was used as the gelatin hardener in the respective layers.

The spectral sensitizers used for the respective emulsions were the following compounds:

Blue-sensitive emulsion layer:

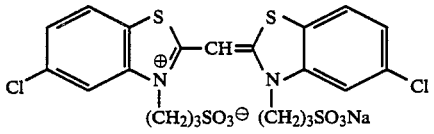

($5.0\times10^{-4}$ mol per mol of the silver halide)

Green-sensitive emulsion layer

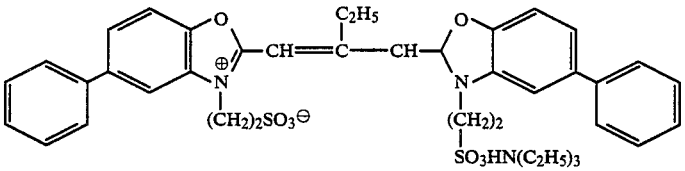

($4.0\times10^{-4}$ mol per mol of the silver halide)

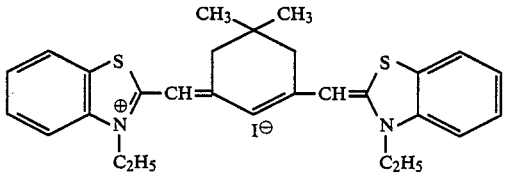

($7.0\times10^{-5}$ mol per mol of the silver halide)

Red-sensitive emulsion layer

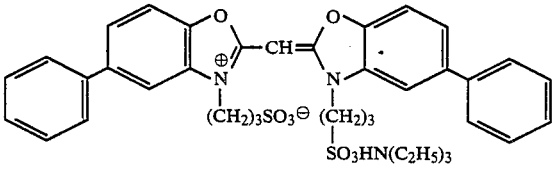

($0.9\times10^{-4}$ mol per mol of the silver halide)

The irradiation-inhibiting dyes in the respective emulsion layers were as follows:

Green-sensitive emulsion layer:

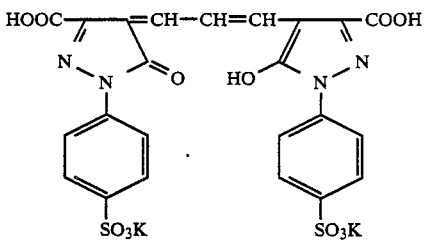

Red-sensitive emulsion layer:

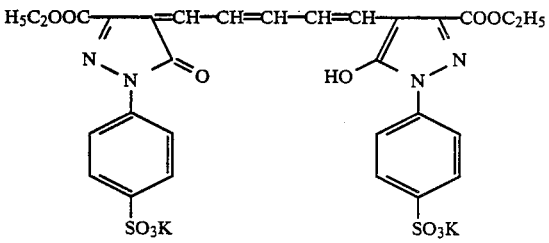

Compounds such as the coupler used in Example 1 had the following structural formulae:

(a) Yellow coupler

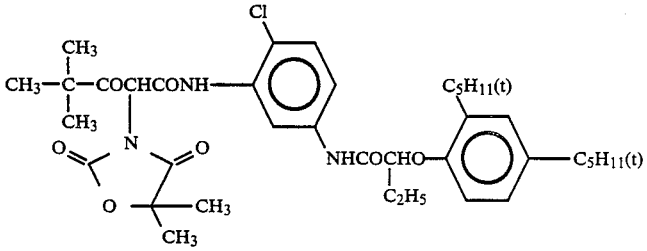

(b) Color image stabilizer

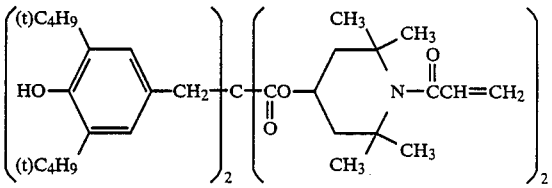

(c) Solvent

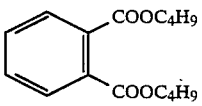

(d) Color-mixing inhibitor

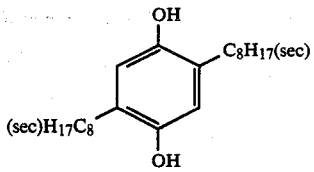
(e) Solvent
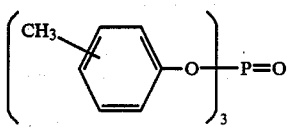
(f) Color image stabilizer
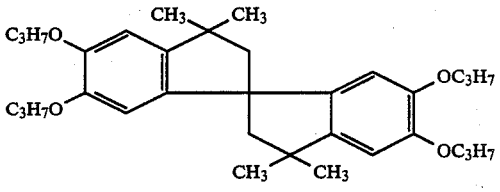
(g) Solvent
Mixture of $(C_3H_{17}O)_3$ P=0 and
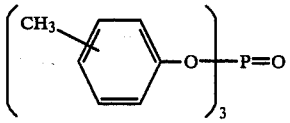
in a weight ratio of 2:1
(h) U.V. absorber
Mixture of
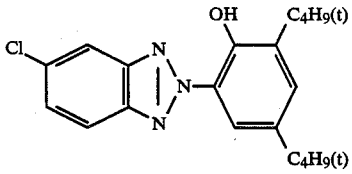
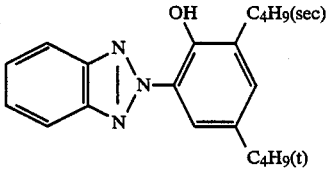
and
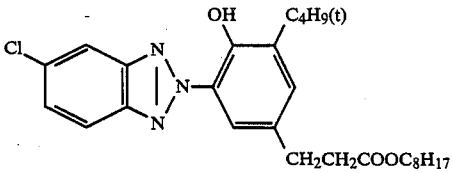
in a molar ratio of 1:5:3
(i) Color mixing inhibitor
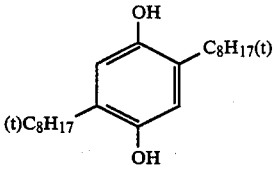
(j) Solvent
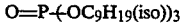
(k) Cyan coupler
Mixture of
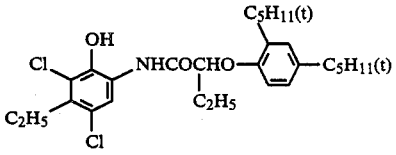
and
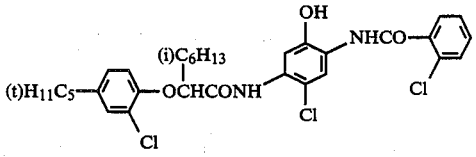
in a molar ratio of 1:1
(l) Color image stabilizer
Mixture of
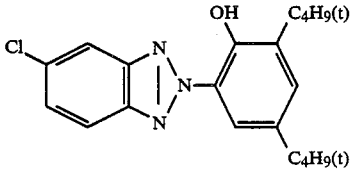
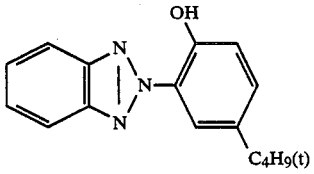
and
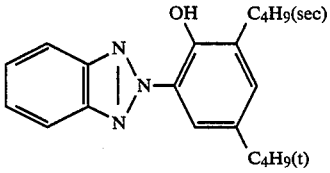
in a molar ratio of 1:3:3
(m) Magenta coupler

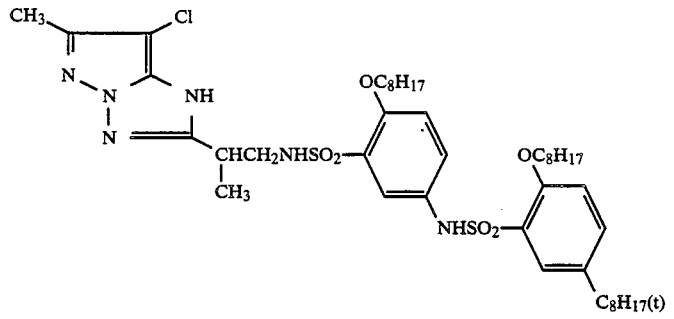

TABLE B

| Layer | Main components | | Amount |
|---|---|---|---|
| The seventh layer (Protective layer) | gelatin | | 1.33 g/m$^2$ |
| | acryl-modified poly-vinyl alcohol copolymer (degree of modification: 17%) | | 0.17 g/m$^2$ |
| The sixth layer (U.V. absorbing layer) | gelatin | | 0.54 g/m$^2$ |
| | U.V. absorber | (h) | 0.21 g/m$^2$ |
| | solvent | (j) | 0.09 cc/m$^2$ |
| The fifth layer (Red-sensitive layer) | silver chlorobromide emulsion (silver bromide content: 1.0 molar %) | silver: | 0.26 g/m$^2$ |
| | gelatin | | 0.98 g/m$^2$ |
| | cyan coupler | (k) | 0.38 g/m$^2$ |
| | color image stabilizer | (l) | 0.17 g/m$^2$ |
| | solvent | (m) | 0.23 cc/m$^2$ |
| The fourth layer (U.V. absorbing layer | gelatin | | 1.60 g/m$^2$ |
| | U.V. absorber | (h) | 0.62 g/m$^2$ |
| | color mixing inhibitor | (i) | 0.05 g/m$^2$ |
| | solvent | (j) | 0.26 cc/m$^2$ |
| The third layer (Green-sensitive layer) | silver chlorobromide emulsion (silver bromide content: 0.5 molar %) | silver: | 0.16 g/m$^2$ |
| | gelatin | | 1.80 g/m$^2$ |
| | Magenta coupler | (m) | 0.34 g/m$^2$ |
| | color image stabilizer | (f) | 0.20 g/m$^2$ |
| | solvent | (g) | 0.68 cc/m$^2$ |
| The second layer (Color-mixing inhibiting layer) | gelatin | | 0.99 g/m$^2$ |
| | color mixing inhibitor | (d) | 0.08 g/m$^2$ |
| The first layer (Blue-sensitive layer) | silver chlorobromide emulsion (silver bromide content: 1.0 molar %) | silver: | 0.30 g/m$^2$ |
| | gelatin | | 1.86 g/m$^2$ |
| | yellow coupler | (a) | 0.82 g/m$^2$ |
| | color image stabilizer | (b) | 0.19 g/m$^2$ |
| | solvent | (c) | 0.34 cc/m$^2$ |
| Support | polyethylene-laminated paper [containing a white pigment ($TiO_2$) and a blue dye (ultramarine) in the polyethylene film adjacent to the first layer] | | |

The photographic printing paper prepared as described above was subjected to the wedge exposure and then processed by the following steps:

| Processing step | Temperature | Time |
|---|---|---|
| Color development | 35° C. | 45 sec. |
| Bleach-fixing | 35° C. | 45 sec. |
| Rinse 1 | 35° C. | 20 sec. |
| Rinse 2 | 35° C. | 20 sec. |
| Rinse 3 | 35° C. | 20 sec. |
| Drying | 80° C. | 60 sec. |

The processing solutions used herein were as follows:

| | | |
|---|---|---|
| Color developer | | |
| triethanolamine | | see Table 1 |
| hydroxyamine | | " |
| sodium sulfite | | " |
| potassium carbonate | | 30 g |
| EDTA.2Na.2$H_2O$ | | 2 g |
| sodium chloride | | 1.0 g |
| 4-amino-3-methyl- N—ethyl- N—[β-(methanesulfonamido)ethyl]-p-phenylenediamine sulfate | | 5.0 g |
| fluorescent brightening agent (4,4'-diaminostilbene compound) | | 3.0 g |
| water | ad | 1000 ml |
| pH | | 10.20 |
| Bleach-fixing solution | | |
| EDTA.Fe(III)$NH_4$.2$H_2O$ | | 60 g |
| EDTA.2Na.2$H_2O$ | | 4 g |
| ammonium thiosulfate (70%) | | 120 ml |
| sodium sulfite | | 16 g |
| glacial acetic acid | | 7 g |
| water | ad | 1000 ml |
| pH | | 5.5 |
| Rinsing solution | | |
| 1-hydroxyethylidene-1,1'-diphosphonic acid (60%) | | 1.6 ml |
| bismuth chloride | | 0.35 g |
| polyvinylpyrrolidone | | 0.25 g |
| aqueous ammonia (26%) | | 2.5 ml |
| 3Na nitrilotriacetate | | 1.0 g |
| EDTA.4H | | 0.5 g |
| sodium sulfite | | 1.0 g |
| 5-chloro-2-methyl-4-isothiazolin-3-one | | 50 mg |
| formalin (37%) | | 0.1 ml |
| water | ad | 1000 ml |
| pH | | 7.0 |

The yellow $D_{min}$ and $D_{max}$ of the produced samples were determined with a Macbeth densitometer. The results are shown in Table 1 as data of the fresh solution.

The color developers were left to stand at 35° C. for two weeks and then processed in the same manner as above. The yellow $D_{min}$ and $D_{max}$ of the samples were determined. The results are shown in Table 1 as data of the aged solutions.

TABLE 1

| No. | Hydroxylamine (0.04 mol/l) | Triethanolamine (mol/l) | Sodium sulfite (mol/l) | | Fresh solution $D_{min}$ | Fresh solution $D_{max}$ | Aged solution $D_{min}$ | Aged solution $D_{max}$ |
|---|---|---|---|---|---|---|---|---|
| 1 | — | — | — | Comparative Example | 0.40 | 2.03 | 0.35 | 1.60 |
| 2 | Hydroxylamine sulfate | — | — | " | 0.11 | 1.78 | 0.25 | 1.65 |
| 3 | " | $7 \times 10^{-2}$ | — | " | 0.10 | 1.82 | 0.21 | 1.83 |
| 4 | " | " | $1 \times 10^{-2}$ | " | 0.10 | 1.58 | 0.11 | 1.60 |
| 5 | N,N—Diethylhydroxylamine | — | — | Present Invention | 0.11 | 1.98 | 0.15 | 1.90 |
| 6 | " | $7 \times 10^{-2}$ | — | " | 0.11 | 2.01 | 0.14 | 1.98 |
| 7 | " | " | $1 \times 10^{-3}$ | " | 0.11 | 2.01 | 0.13 | 1.98 |
| 8 | " | " | $5 \times 10^{-3}$ | " | 0.11 | 2.00 | 0.11 | 1.98 |
| 9 | " | " | $1 \times 10^{-2}$ | " | 0.11 | 1.98 | 0.11 | 1.98 |
| 10 | " | " | $5 \times 10^{-2}$ | " | 0.11 | 1.90 | 0.11 | 1.91 |
| 11 | N,N—Dimethylhydroxylamine | — | — | " | 0.11 | 1.96 | 0.15 | 1.96 |
| 12 | " | $7 \times 10^{-2}$ | $1 \times 10^{-2}$ | " | 0.11 | 1.96 | 0.11 | 1.94 |

It is apparent from Table 1 that the color development was reduced and the staining was increased with time when hydroxylamine was used (No. 2), that the color development was not improved significantly and the inhibition of the staining was insufficient when triethanolamine was used (No. 3) and that the color development was seriously inhibited, though staining was also inhibited, when sodium sulfite was used (No. 4).

It is also apparent that the color development was excellent and the increase of the stain with time was only slight when the hydroxylamine of the present invention was used (No. 5). Further, the increase of the stain was reduced when triethanolamine was added (No. 6) and the stain was not increased and the color development was excellent when a suitable amount of sodium sulfite was used (Nos. 8 and 9).

EXAMPLE 2

The first layer (the bottom layer) through the seventh layer (the top layer) were formed on a paper which had been processed by a corona discharge and had had both surfaces laminated with polyethylene as shown in Table C to produce a sample.

A coating solution for forming the first layer was prepared as follows: a mixture of 200 g of a yellow coupler shown in the table, 93.3 g of a discoloration inhibitor, 10 g of a high-boiling solvent (p), 5 g of a high-boiling solvent (q) and 600 ml of ethyl acetate as the assistant solvent was heated to 60° C. The obtained solution was mixed with 3,300 ml of 5% aqueous gelatin solution containing 330 ml of 5% aqueous solution of Alkanol B (alkyl naphthalenesulfonate; a product of Du Pont Co.). The obtained mixture was emulsified with a colloid mill to prepare a coupler dispersion. Ethyl acetate was distilled off from the dispersion under reduced pressure and the residue was added to 1,400 g (96.7 g in terms of Ag; containing 170 g of gelatin) containing a sensitizing dye for the blue-sensitive emulsion layer and 1-methyl-2-mercapto-5-acetylamino-1,3,4-triazole. Then, 2,600 g of 10% aqueous gelatin solution was added to the mixture to prepare a coating solution. The coating solutions for forming the second layer through the seventh layer were prepared in the same manner as above, except that the halogen composition of the silver chlorobromide emulsion in the third layer was changed as shown in Table 2.

TABLE C

| Layer | Components | |
|---|---|---|
| The seventh layer | gelatin | 600 mg/m$^2$ |
| (Protective layer) | | |
| The sixth layer | U.V. absorber (n) | 260 mg/m$^2$ |
| (U.V. absorbing layer) | U.V. absorber (o) | 70 mg/m$^2$ |
| | solvent (p) | 300 mg/m$^2$ |
| | solvent (q) | 100 mg/m$^2$ |
| | gelatin | 700 mg/m$^2$ |
| The fifth layer | silver chlorobromide | 210 mg/m$^2$ |
| (red-sensitive layer) | emulsion (silver bromide content: 1 molar %) | |
| | cyan coupler (C-2) | 260 mg/m$^2$ |
| | cyan coupler (C-1) | 120 mg/m$^2$ |
| | discoloration inhibitor (r) | 250 mg/m$^2$ |
| | solvent (p) | 160 mg/m$^2$ |
| | solvent (q) | 100 mg/m$^2$ |
| | gelatin | 1800 mg/m$^2$ |
| The fourth layer | color mixing inhibitor (s) | 65 mg/m$^2$ |
| (color mixing-inhibiting layer) | U.V. absorber (n) | 450 mg/m$^2$ |
| | U.V. absorber (o) | 230 mg/m$^2$ |
| | solvent (p) | 50 mg/m$^2$ |
| | solvent (q) | 50 mg/m$^2$ |
| | gelatin | 1700 mg/m$^2$ |
| The third layer | silver chlorobromide | 305 mg/m$^2$ |
| (green-sensitive layer) | emulsion (silver bromide content: 3 molar %) | |
| | Magenta coupler | 670 mg/m$^2$ |
| | discoloration inhibitor (t) | 150 mg/m$^2$ |
| | discoloration inhibitor (u) | 10 mg/m$^2$ |
| | solvent (p) | 200 mg/m$^2$ |
| | solvent (q) | 10 mg/m$^2$ |
| | gelatin | 1400 mg/m$^2$ |
| The second layer | silver bromide silver | 10 mg/m$^2$ |
| (color mixing- | emulsion (non-post- | |

TABLE C-continued

| Layer | Components | |
|---|---|---|
| inhibiting layer) | heated; grain diameter: 0.05 μ) | |
| | color mixing inhibitor (s) | 55 mg/m² |
| | solvent (p) | 30 mg/m² |
| | solvent (q) | 15 mg/m² |
| | gelatin | 800 mg/m² |
| The first layer | silver chlorobromide | 290 mg/m² |
| (blue-sensitive layer) | emulsion (silver bromide content: 5 molar %) | |
| | yellow coupler | 600 mg/m² |
| | color mixing inhibitor (r) | 280 mg/m² |
| | solvent (p) | 30 mg/m² |
| | solvent (q) | 15 mg/m² |
| | gelatin | 1800 mg/m² |
| Support | Paper support the both surfaces of which were laminated with polyethylene | |

Green-sensitive emulsion layer: anhydro-9-ethyl-5,5'-diphenyl-3,3'-disulfoethyloxacarbocyanine hydroxide Red-sensitive emulsion layer: 3,3'-diethyl-5-methoxy-9,9'-(2,2-dimethyl-1,3-propano)thiadicarbocyanine iodide.

The emulsifier used for the respective emulsion layers was 1-methyl-2-mercapto-5-acetylamino-1,3,4-triazole.

The irradiation-inhibiting dyes used were as follows: dipotassium 4-(3-carboxy-5-hydroxy-4-(3-(3-carboxy-5-oxo-1-(4-sulfonatophenyl)-2-pyrazoline-4-ylidene)-1-propenyl)-1-pyrazolyl)-benzenesulfonate, and tetrasodium N,N'-(4,8-dihydroxy-9,10-dioxo-3,7-disulfonatoanthracene-1,5-diyl)bis(amonomethanesulfonate).

The hardener used was 1,2-bis(vinylsulfonyl)ethane.

The couplers used were as follows:

Yellow coupler:

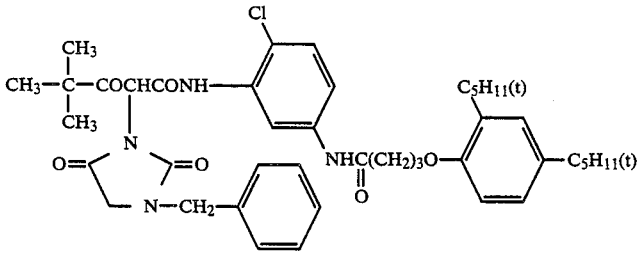

Magenta coupler:

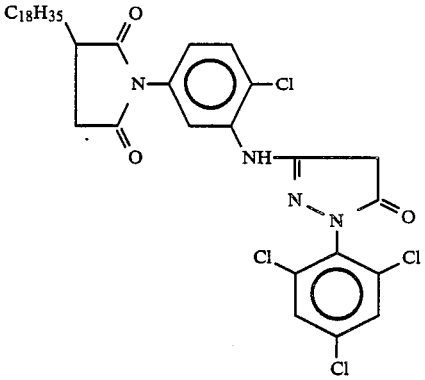

Cyan coupler (mixture of C-1 and C-2 in a molar ratio of 50:50):

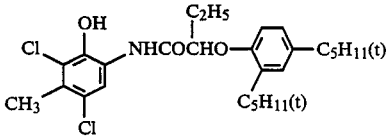

C-1

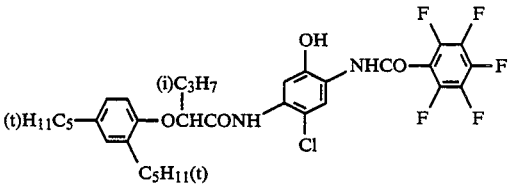

C-2

The multilayered color photographic printing paper prepared as described above was subjected to the wedge exposure and then processed by the following steps:

| Processing step | Temperature | Time |
|---|---|---|
| Color development | 3 min. 30 sec. | 33° C. |
| Bleach-fixing | 1 min. 30 sec. | 33° C. |
| Rinse (3-tank cascade) | 3 min. | 30° C. |
| Drying | 1 min. | 80° C. |

The processing solutions used herein were as follows:

| Color developer | |
|---|---|
| water | 800 ml |
| benzyl alcohol | see Table 2 |
| triethanolamine | 10 ml |
| diethylenetriaminepentaacetic acid | 1.0 g |
| N,N'—bis(2-hydroxybenzyl)ethylenediamine—N,N'—diacetic acid | 0.1 g |

-continued

| | | |
|---|---|---|
| nitrilo—N,N,N—trimethylenephosphonic acid (40%) | | 1.0 g |
| potassium chloride | | 1.0 g |
| sodium sulfite | | see Table 2 |
| hydroxylamine | | " |
| sodium bromide | | 0.8 g |
| N—ethyl- N—(β-methanesulfonamido-ethyl)-3-methyl-4-aminoaniline sulfate | | 5.5 g |
| fluorescent brightening agent (4,4'-diaminostilbene compound) | | 1.0 g |
| water | ad | 1000 ml |
| pH adjusted with KOH | | 10.10 |
| Bleach-fixing solution | | |
| ammonium thiosulfate (70%) | | 150 ml |
| sodium sulfite | | 15 g |
| iron (III) ammonium ethylenediamine | | 60 g |
| ethylenediaminetetraacetic acid | | 10 g |
| fluorescent brightening agent (4,4'-diaminostilbene compound) | | 1.0 g |
| 2-mercapto-5-amino-3,4-thiadiazole | | 1.0 g |
| water | ad | 1000 ml |
| pH (adjusted with aqueous ammonia) | | 7.0 |
| Rinsing solution | | |
| 5-chloro-2-methyl-4-isothiazolin-3-one | | 40 mg |
| 2-methyl-4-isothiazolin-3-one | | 10 mg |
| 2-octyl-4-isothiazolin-3-one | | 10 mg |
| bismuth chloride (40%) | | 0.5 g |
| nitrilo—N,N,N—trimethylenephosphonic acid (40%) | | 1.0 g |
| 1-hydroxyethylidene-1,1-diphosphonic acid (60%) | | 2.5 g |
| fluorescent brightening agent (4,4'-diaminostilbene compound) | | 1.0 g |
| aqueous ammonia (26%) | | 2.0 ml |
| water | ad | 1000 ml |
| pH (adjusted with KOH) | | 7.5 |

The photosensitive material was processed with the developer immediately after preparation and after storage. The Megenta $D_{min}$ and $D_{max}$ of the processed sensitive materials were determined in the same manner as in Example 1. The results are summarized in Table 2.

TABLE 2

| | No. | Silver chlorobromide emulsion (Cl %)/(Br %) | Benzyl alcohol (ml/l) | Hydroxylamine (0.03 mol/l) | Sodium sulfite (mol/) | Fresh solution $D_{min}$ | Fresh solution $D_{max}$ | Aged solution $D_{min}$ | Aged solution $D_{max}$ |
|---|---|---|---|---|---|---|---|---|---|
| Comparative Example | 13 | 50/50 | 15 | hydroxylamine sulfate | $1 \times 10^{-2}$ | 0.11 | 2.13 | 0.11 | 2.14 |
| | 14 | 100/0 | 15 | " | " | 0.15 | 2.35 | 0.16 | 2.35 |
| | 15 | 50/50 | — | " | " | 0.11 | 1.65 | 0.11 | 1.65 |
| | 16 | 50/50 | — | N,N—diethylhydroxylamine | " | 0.11 | 2.01 | 0.11 | 2.00 |
| | 17 | 70/30 | — | " | " | 0.11 | 2.09 | 0.11 | 2.09 |
| | 18 | 100/0 | 15 | " | " | 0.15 | 2.34 | 0.17 | 2.35 |
| Present Invention | 19 | 80/20 | — | " | " | 0.11 | 2.31 | 0.11 | 2.30 |
| | 20 | 90/10 | — | " | " | 0.11 | 2.32 | 0.11 | 2.33 |
| | 21 | 100/0 | — | " | — | 0.11 | 2.34 | 0.12 | 2.34 |

It is apparent from the results shown in Table 2 that when the silver chloride content was beyond the range of the present invention, the color development was reduced (Nos. 15 and 17) and that even when it was within the range of the present invention, the fog was increased in the presence of benzyl alcohol.

It is understood, therefore, that excellent development is possible when the processing is conducted with the developer substantially free of benzyl alcohol according to the method of the present invention (Nos. 19 to 21).

EXAMPLE 3

The processing was conducted in the same manner as in Example 1 except that Compound (5), (6), (8), (11), (16) or (19) was used in place of N,N-diethylhydroxylamine to obtain excellent storage stability as in Example 1.

What is claimed is:

1. A method of processing a silver halide color photosensitive material comprising, processing an exposed silver halide color photosensitive material having at least one emulsion layer containing a silver halide having a chlorine content of at least 80 molar % based on the total halogens with a color developer which is substantially free of benzyl alcohol, said color developer (i) having a pH of about 9 to about 11, (ii) containing sulfites in an amount ranging from about 0 to about 5 g/l, (iii) containing an aromatic primary amine color developing agent, and (iv) containing a dialkylhydroxylamine of the following general formula (I):

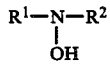

(I)

wherein $R^1$ and $R^2$ each represent an unsubstituted or substituted alkyl group or an unsubstituted or substituted alkenyl group or $R^1$ and $R^2$ may form a hetero ring together with nitrogen atom.

2. The method as set forth in claim 1, wherein the aromatic primary amine color developing agent is selected from p-phenylenediamine derivatives.

3. The method as set forth in claim 1, wherein the color developer contains the aromatic primary amine color developing agent in an amount of about 0.1 g to 20 per liter of the developer.

4. The method as set forth in claim 1, wherein $R^1$ and $R^2$ in the formula (I) each has 1 to 5 carbon atoms.

5. The method as set forth in claim 1, wherein the dialkylhydroxylamine is selected from the group of

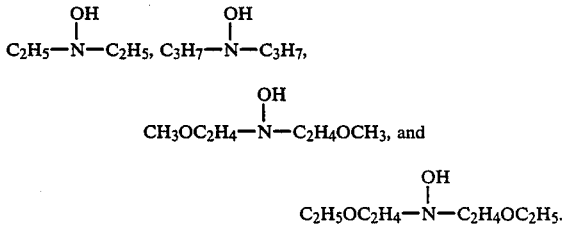

6. The method as set forth in claim 1, wherein the dialkylhydroxylamine is contained in an amount of about 0.05 to about 20 g/l in the developer.

7. The method as set forth in claim 1, wherein no benzyl alcohol is contained in the developer.

8. The method as set forth in claim 1, wherein the photosensitive material is developed at a temperature of about 20° to about 50° C. for about 20 seconds to about 5 minutes.

9. The method as set forth in claim 1, wherein the emulsion layer contains a silver halide having a chlorine content of at least 90 molar % based on the total halogens.

10. The method as set forth in claim 1, wherein the developer further contains (v) an alkanolamine having the following formula (II):

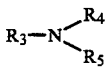

(II)

wherein $R_3$ represents a hydroxyalkyl group having 2 to 6 carbon atoms and $R_4$ and $R_5$ each represent a hydrogen atom, an alkyl group having 1 to 6 carbon atoms, hydroxyalkyl group having 2 to 6 carbon atoms, benzyl group or a group of the formula:

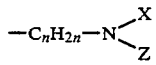

in which n is an integer of 1 to 6 and X and Z each represent a hydrogen atom, an alkyl group having 1 to 6 carbon atoms or a hydroxyalkyl group having 2 to 6 carbon atoms.

11. The method as set forth in claim 10, wherein the alkanolamine is contained in an amount of about 0.01 to about 20 g per liter of the developer.

12. The method as set forth in claim 1, wherein the developer contains sulfite ion.

13. The method as set forth in claim 1, wherein the developer contains $1\times10^{-4}$ to $5\times10^{-2}$ mol of sulfite ion per liter of the developer.

14. The method as set forth in claim 1, wherein the developer contains $2.5\times10^{-3}$ to $2.5\times10^{-2}$ mol of sulfite ion per liter of the developer.

15. The method as set forth in claim 1, wherein the color photographic material contains a nitrogen atom-split-off yellow coupler.

* * * * *